US009637911B2

(12) United States Patent
Doupe et al.

(10) Patent No.: US 9,637,911 B2
(45) Date of Patent: May 2, 2017

(54) JOIST CONNECTOR

(71) Applicant: KLEVAKLIP SYSTEMS PTY LTD., Cromer (AU)

(72) Inventors: Greg James Doupe, Cromer (AU); Stephen Ley Sanders, Cromer (AU)

(73) Assignee: KLEVAKLIP SYSTEMS PTY LTD., Cromer NSW (AU)

( * ) Notice: Subject to any disclaimer, the term of this patent is extended or adjusted under 35 U.S.C. 154(b) by 0 days.

(21) Appl. No.: 14/790,637

(22) Filed: Jul. 2, 2015

(65) Prior Publication Data

US 2016/0002912 A1 Jan. 7, 2016

(30) Foreign Application Priority Data

Jul. 4, 2014 (AU) ..... 2014902579

(51) Int. Cl.
*E04B 1/26* (2006.01)

(52) U.S. Cl.
CPC ..... *E04B 1/2604* (2013.01); *E04B 1/2612* (2013.01)

(58) Field of Classification Search
CPC ... E04B 1/40; E04B 2103/04; E04B 2001/405
See application file for complete search history.

(56) References Cited

U.S. PATENT DOCUMENTS 1,833,043 A * 11/1931 Sheldon ..... E04C 3/07 29/509
1,848,085 A * 3/1932 Eisenschmidt ..... 403/187
2,101,317 A * 12/1937 Lemieux ..... 403/53
2,217,055 A * 10/1940 Jennens ..... 403/399
4,160,350 A * 7/1979 Craib ..... E04C 3/292 411/458
D256,663 S * 9/1980 Gilb ..... D8/354
4,230,416 A * 10/1980 Gilb ..... 403/232.1
5,359,143 A * 10/1994 Simon ..... H02G 3/0608 138/157
5,481,844 A * 1/1996 Kajita ..... 52/702
D492,889 S * 7/2004 Craine ..... D8/354
6,931,813 B2 * 8/2005 Collie ..... E04B 7/063 52/702
7,766,576 B2 * 8/2010 Connell et al. ..... 403/400
7,971,410 B2 * 7/2011 Jerke ..... E04B 7/045 52/702
8,225,575 B2 * 7/2012 Gadd ..... E04B 1/2612 52/289
8,978,339 B2 * 3/2015 Doupe ..... E04B 1/38 52/702
9,347,213 B1 * 5/2016 Zhang ..... E04B 1/40
2002/0078656 A1 * 6/2002 Leek et al. ..... 52/702
2004/0163355 A1 * 8/2004 Collie ..... E04B 7/063 52/702
2006/0150564 A1 * 7/2006 Dufault ..... E04B 7/045 52/702
2006/0191233 A1 * 8/2006 Tamlyn ..... 52/702
2007/0145222 A1 * 6/2007 Rausch ..... F16L 3/02 248/317
2007/0294979 A1 * 12/2007 Lin ..... E04B 1/2612 52/702

* cited by examiner

*Primary Examiner* — Jeanette E Chapman
(74) *Attorney, Agent, or Firm* — Lando & Anastasi, LLP

(57) ABSTRACT

A joist connector including a unitary body with a first channel defined by at least two spaced apart flanges and a second channel defined by at least two spaced apart flanges and offset from the first channel.

11 Claims, 6 Drawing Sheets

JOIST CONNECTOR

CROSS-REFERENCE TO RELATED APPLICATION

This application claims priority under 35 U.S.C. §119(a)-(d) to Australian Patent Application No. AU 2014902579, filed on Jul. 4, 2014, which is hereby incorporated by reference.

TECHNICAL FIELD

The present invention relates generally to the field of construction apparatus and particularly to the connection of joists to bearers in a floor support structure.

BACKGROUND ART

In most decking situations, a deck built from the ground up contains stumps, bearers, joists and decking boards. It is common practice to bolt the bearers to the stumps and screw the decking boards to the joists. With regards to attaching the joists to the bearers, in some situations, the joists are "hung" inside the bearers using joist hangers. More commonly, the joists sit on top of and at 90 degrees to the bearers.

It is common practice to simply skew-nail the joists to the bearers. Whilst this is a legal practice, the skew-nailing is often a haphazard practice—as it is done at an angle to the joist and bearer, it is often debatable just how much of the joist is actually anchored to the bearer by the nails (the nails aren't too far up from the bottom of the joists). It is also common, especially with hardwood joists, to split the joist in the skew-nailing process—making the holding power minimal at best.

There are products such as metal "triple grips", and "uni-ties" available on the market which are frequently used to bolster the connection of the joist to the bearer. Such products work, however are very often only connected to one side of the joist to save time and the like (so often only do a partial job). They are also attached after the skew-nailing has already been completed, so is seen as a doubling up of labour.

It will be clearly understood that, if a prior art publication is referred to herein, this reference does not constitute an admission that the publication forms part of the common general knowledge in the art in Australia or in any other country.

SUMMARY OF INVENTION

The present invention is directed to a joist connector, which may at least partially overcome at least one of the abovementioned disadvantages or provide the consumer with a useful or commercial choice.

With the foregoing in view, the present invention in one form, resides broadly in a joist connector including a unitary body with a first channel defined by at least two spaced apart flanges and a second channel defined by at least two spaced apart flanges and offset from the first channel.

The joist connector of the present invention is typically used to connect a beam or other support extending in a first direction with a joist or similar elongate support extending in another direction without the need to skew nail or skew fix. Although described and named as a "joist connector", the device of the present invention can be used to connect a beam or other support extending in a first direction with a joist or similar elongate support extending in another direction, regardless of orientation.

Normally, the joist connector of the present invention will be located between the ends of the beam and/or joist but the joist connector can also be used at the ends of the beam or joist, usually with an orientation change.

The joist connector of the present invention preferably has a one-piece construction. The joist connector may be formed from any material but a plastic or similar material is preferred. A particularly preferred material is a polyamide such as Nylon 6 as this material is strong, tough and has a high degree of UV stability, especially once conditioned properly.

It is particularly preferred that the joist connector of the present invention be conditioned, especially if formed of a polyamide such as Nylon 6. Preferably, active conditioning will be used in order to increase the strength of the material. Active conditioning preferably increases the flexibility and impact toughness of the material and can decrease tensile strength and stiffness.

Given that the use of the joist connector of the present invention will normally be in compression, the decrease in tensile strength that may be a result of the conditioning process will typically not been issue or be less of an issue, particularly when balanced with the advantages of increased impact toughness and flexibility of the joist connector.

It is preferred that the joist connector of the present invention is formed by a moulding process.

The joist connector of the present invention includes a first channel defined by at least two spaced apart flanges. The first channel will typically be substantially perpendicular to the second channel but may be at an angle other than perpendicular if desired. The first channel is typically adapted to receive a portion of a beam.

The first channel will typically be defined by a pair of spaced apart flanges. The pair of flanges are typically parallel to one another. Each flange is preferably planar. The flanges are typically spaced from one another by a standard distance which corresponds to a standard or preferred width of a support beam. The flanges typically receive a support beam therebetween and the flanges are then preferably attached directly to the beam.

Each of the flanges may be the slightly resilient due in part to the material used but mainly due to the dimension (thickness) of the flanges. The slight resilience preferably allows a small amount of deformation to occur in order to allow the first channel to receive the beam. Typically, the beam will be received in a close fit with the internal surfaces of each of the flanges abutting the sidewalls of the beam.

According to a particularly preferred embodiment, a transverse wall is provided connecting the flanges together at one end thereof. Normally, the transverse wall will also abut a sidewall of the beam when the joist connector is properly located, allowing the beam to support the transverse wall.

At least one, and typically a number of openings are provided in each of the flanges in order to allow a fastener to be driven through an opening and into the beam. Typically the fasteners will be elongate fasteners such as screws or nails with an enlarged heads. In use, the elongate fasteners will typically be driven through the openings into the beam such that the head of the fasteners will abut the periphery or surround of the opening in the flange to attach the joist connector to the beam. Normally the elongate fasteners extend laterally into the beam.

The joist connector of the present invention includes a second channel defined by at least two spaced apart flanges. The second channel will typically be substantially perpendicular to the first channel but may be at an angle other than perpendicular if desired. The second channel is typically adapted to receive a portion of a joist.

The second channel will typically be defined by a pair of spaced apart flanges. The pair of flanges are typically parallel to one another. Each flange is preferably planar. The flanges are typically spaced from one another by a standard distance which corresponds to a standard or preferred width of a joist. The flanges typically receive the joist being therebetween and the flanges are then preferably attached directly to the joist.

Each of the flanges may be slightly resilient due in part to the material used but mainly due to the dimension (thickness) of the flanges. The slight resilience preferably allows a small amount of deformation to occur in order to allow the second channel to receive the joist. Typically, the joist will be received in a close fit with the internal surfaces of each of the flanges abutting the sidewalls of the joist.

According to a particularly preferred embodiment, a transverse wall is provided connecting the flanges together at one end thereof. Normally, the transverse wall will also abut a lower sidewall of the joist when the joist connector is properly located allowing the joist to be supported on or by the transverse wall.

According to a particularly preferred embodiment, the transverse wall of the second channel is also the transverse wall of the first channel.

Preferably, one or more spacer ridges may be provided on the second channel side of the transverse wall connecting the flanges. Normally a pair of spacer ridges are provided, each with a surface which is substantially coplanar in order to space the joist from the transverse wall. The spacer ridges are preferably parallel to one another, spaced apart and extend across the width of the transverse wall. One or more channels will typically be defined between the spacer ridges and this may allow drainage through the joist connector beneath the joist, limiting rot.

At least one, and typically a number of openings are provided in each of the flanges in order to allow a fastener to be driven through an opening and into the joist. Typically the fasteners will be elongate fasteners such as screws or nails with an enlarged heads. In use, the elongate fasteners will typically be driven through the openings into the joist such that the head of the fasteners will abut the periphery or surround of the opening in the flange to attach the joist connector to the joist. Normally the elongate fasteners extend laterally into the joist.

One or more bracing structures will typically be provided in order to brace the flanges relative to one another. Typically, bracing members are provided in order to brace the flanges in both directions. The bracing members will normally be substantially triangular shaped with one portion abutting one of the flanges and a second portion abutting another of the flanges or another bracing portion.

In another broad form, the present invention resides in a joist connector including a unitary body with a channel defined by at least two spaced apart flanges and a face mount assembly defined by at least two spaced apart flanges offset from the channel.

In this alternative embodiment, a joist connector is provided to face mount a beam or joist relative to a second beam or joist. This configuration of joist connector is typically provided at the end of a beam or joist.

In this embodiment, the joist connector includes a channel defined by at least two spaced apart flanges. The channel will typically be substantially perpendicular to the face mount assembly but may be at an angle other than perpendicular if desired. The first channel is typically adapted to receive a portion of a beam.

The channel will typically be defined by a pair of spaced apart flanges. The pair of flanges are typically parallel to one another. Each flange is preferably planar. The flanges are typically spaced from one another by a standard distance which corresponds to a standard or preferred width of a support beam. The flanges typically receive a support beam therebetween and the flanges can be attached directly to the beam.

Each of the flanges may be the slightly resilient due in part to the material used but mainly due to the dimension (thickness) of the flanges. The slight resilience preferably allows a small amount of deformation to occur in order to allow the channel to receive the beam. Typically, the beam will be received in a close fit with the internal surfaces of each of the flanges abutting the sidewalls of the beam.

According to a particularly preferred embodiment, a transverse wall is provided connecting the flanges together at one end thereof. Normally, the transverse wall will also abut a sidewall of the beam when the joist connector is properly located to support the beam.

Preferably, one or more spacer ridges may be provided on the transverse wall. Normally a pair of spacer ridges are provided, each with a surface which is substantially coplanar in order to space the joist from the transverse wall. The spacer ridges are preferably parallel to one another, spaced apart and extend across the width of the transverse wall. One or more channels will typically be defined between the spacer ridges and this may allow drainage through the joist connector beneath the joist, limiting rot.

At least one, and typically a number of openings are provided in each of the flanges in order to allow a fastener to be driven through an opening and into the beam. Typically the fasteners will be elongate fasteners such as screws or nails with an enlarged heads. In use, the elongate fasteners will typically be driven through the openings into the beam such that the head of the fasteners will abut the periphery or surround of the opening in the flange to attach the joist connector to the beam. Normally the elongate fasteners extend laterally into the beam.

The joist connector of the present invention includes a face mount assembly including at least two spaced apart flanges. The flanges of the face mount assembly will typically be substantially perpendicular to the channel but may be at an angle other than perpendicular if desired. As the name suggests, the face mount assembly is typically adapted to abut a beam or joist in order to mount the beam in the channel relative thereto in a face mount configuration.

The face mount assembly preferably includes a pair of spaced apart flanges. The pair of flanges are typically coplanar to one another. Each flange is preferably planar. The flanges are typically spaced from one another by a standard distance which corresponds to the width of the channel. The flanges typically receive the beam or joist being therebetween. The flanges are then preferably attached directly to a second beam or joist.

Each of the flanges may be slightly resilient due in part to the material used but mainly due to the dimension (thickness) of the flanges. The slight resilience preferably allows a small amount of deformation to occur in order to allow the face mount assembly to match any inconsistencies in external shape of the beam or joist to which the joist connector is attached.

At least one, and typically a number of openings are provided in each of the flanges of the face mount assembly in order to allow a fastener to be driven through an opening and into the face of a beam or joist. Typically the fasteners will be elongate fasteners such as screws or nails with an enlarged heads. In use, the elongate fasteners will typically be driven through the openings into the beam or joist such that the head of the fasteners will abut the periphery or surround of the opening in the flange to attach the joist connector to the beam or joist. Normally the elongate fasteners extend laterally into the beam or joist.

One or more bracing structures will typically be provided in order to brace the respective flanges of the channel relative to the respective flanges of the face mount assembly. Typically, bracing members are provided in order to brace the flanges in both directions. The bracing members will normally be substantially triangular shaped with one portion abutting one of the flanges and a second portion abutting another of the flanges or another bracing portion preferably integrally formed therewith.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
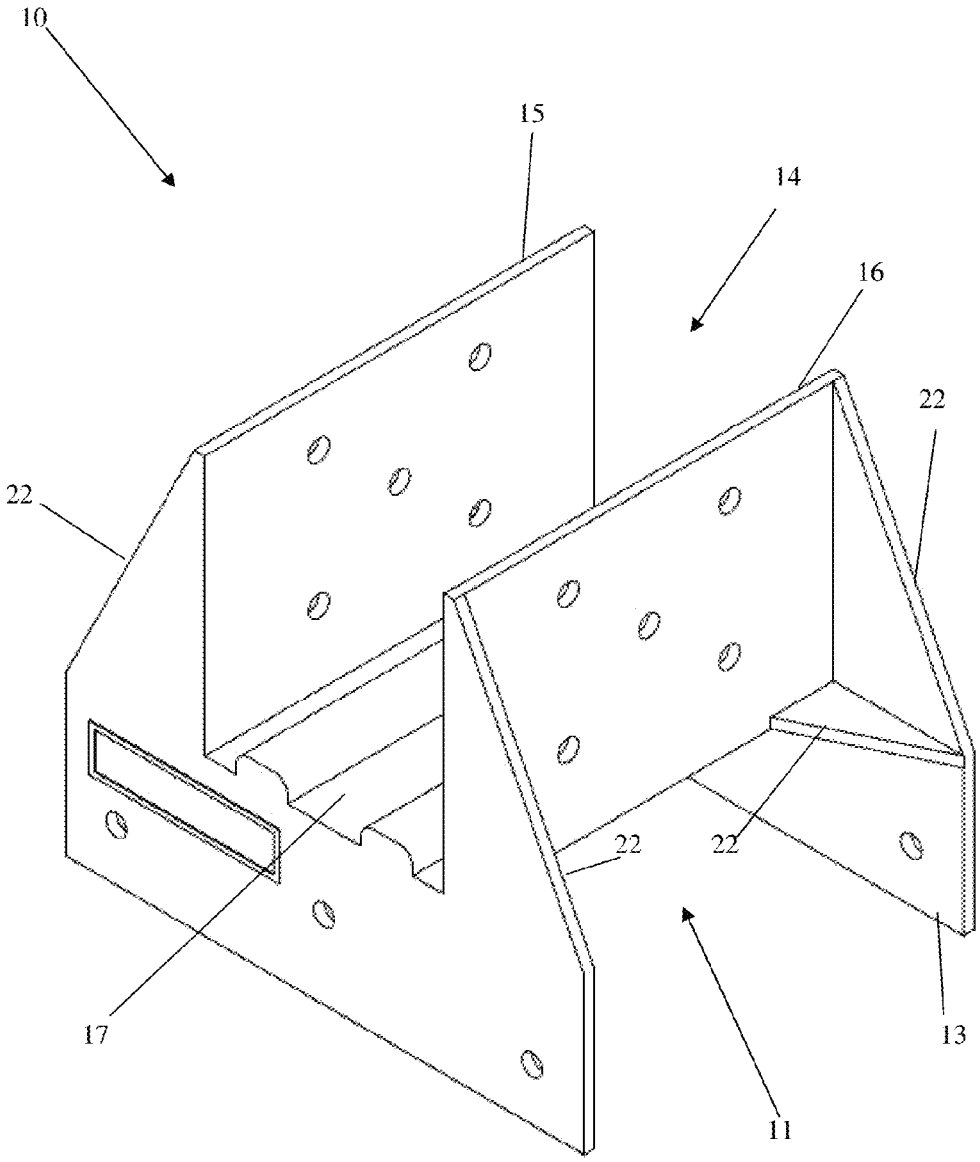
FIG. 1 is an isometric view of a joist connector according to a preferred embodiment of the present invention.
Figure 2:
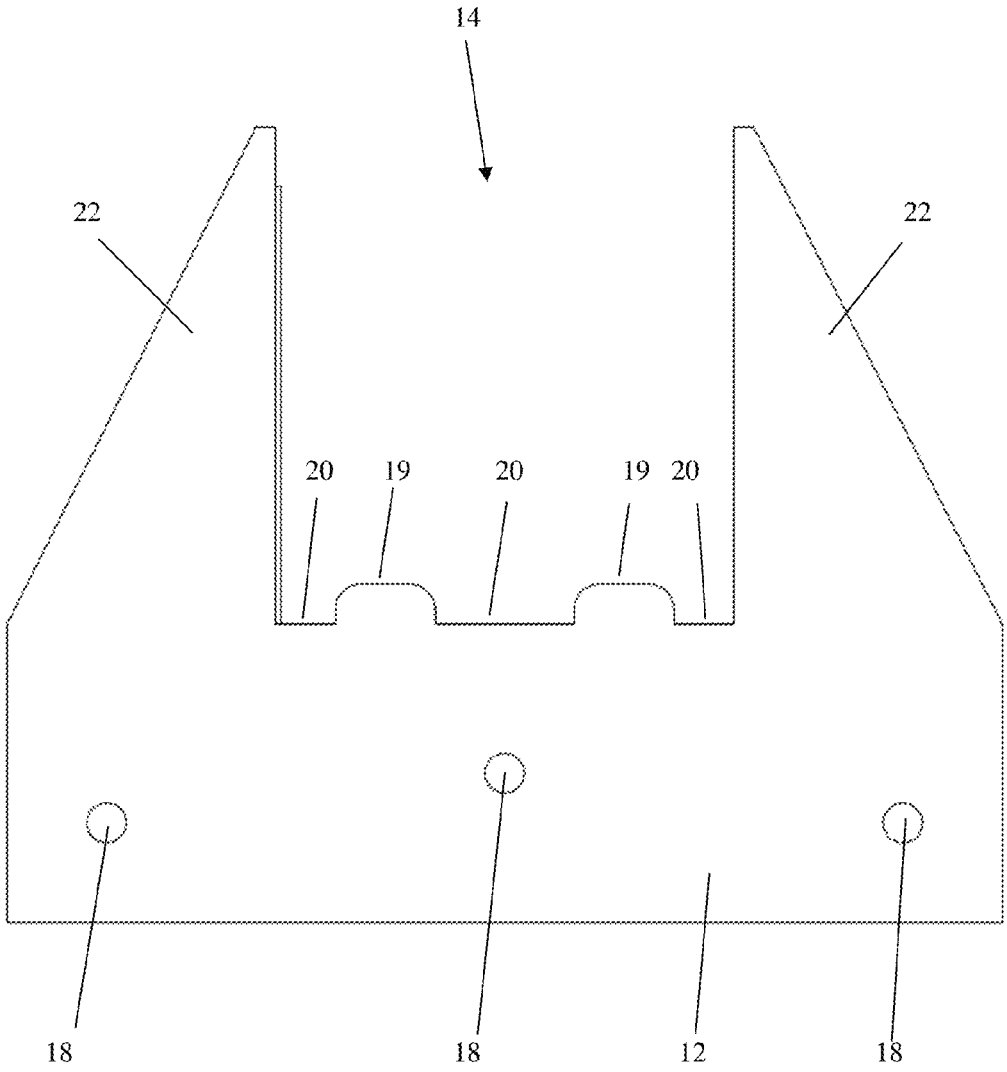
FIG. 2 is a front elevation view of the joist connector illustrated in FIG. 1.
Figure 3:
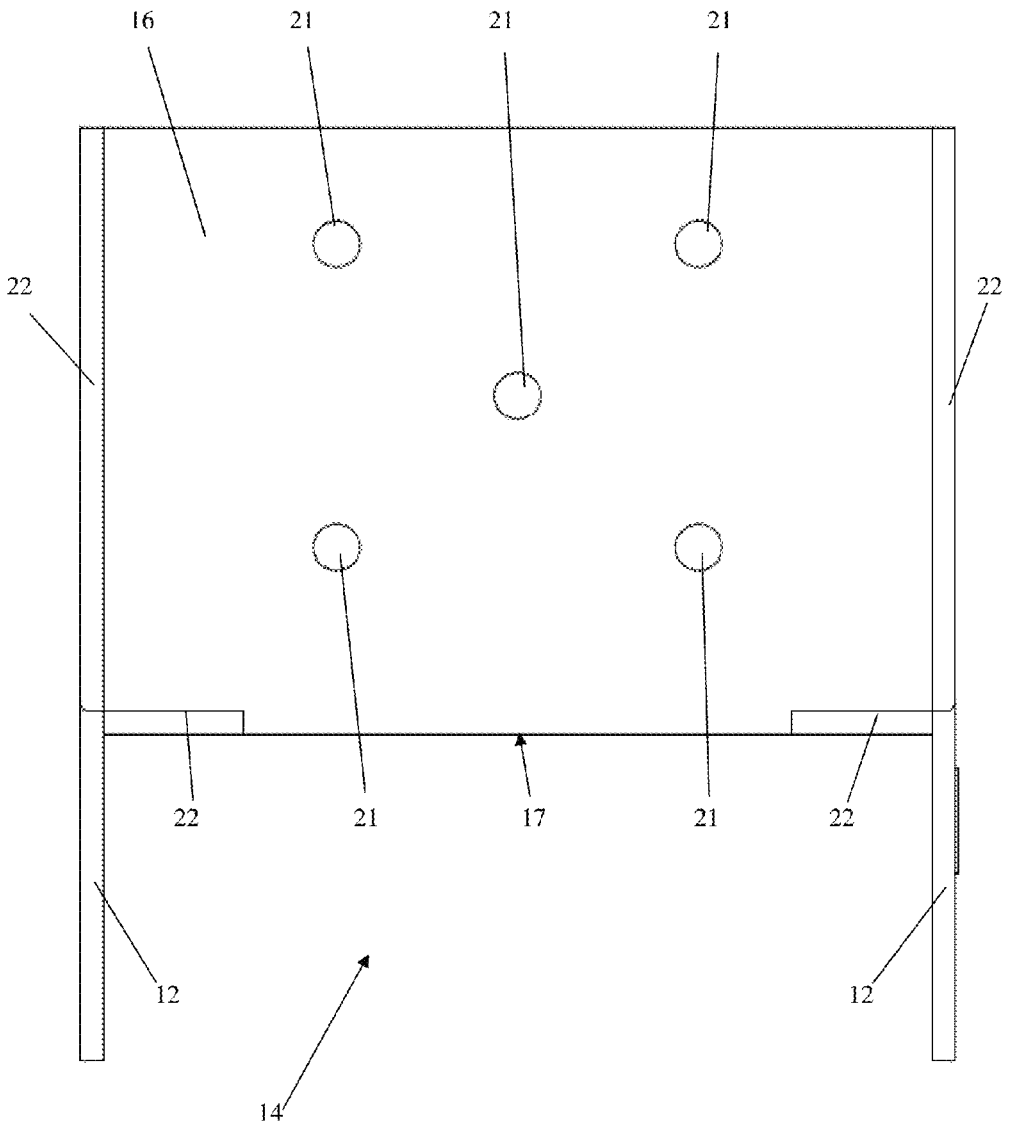
FIG. 3 is a side elevation view of the joist connector illustrated in FIG. 1.
Figure 4:
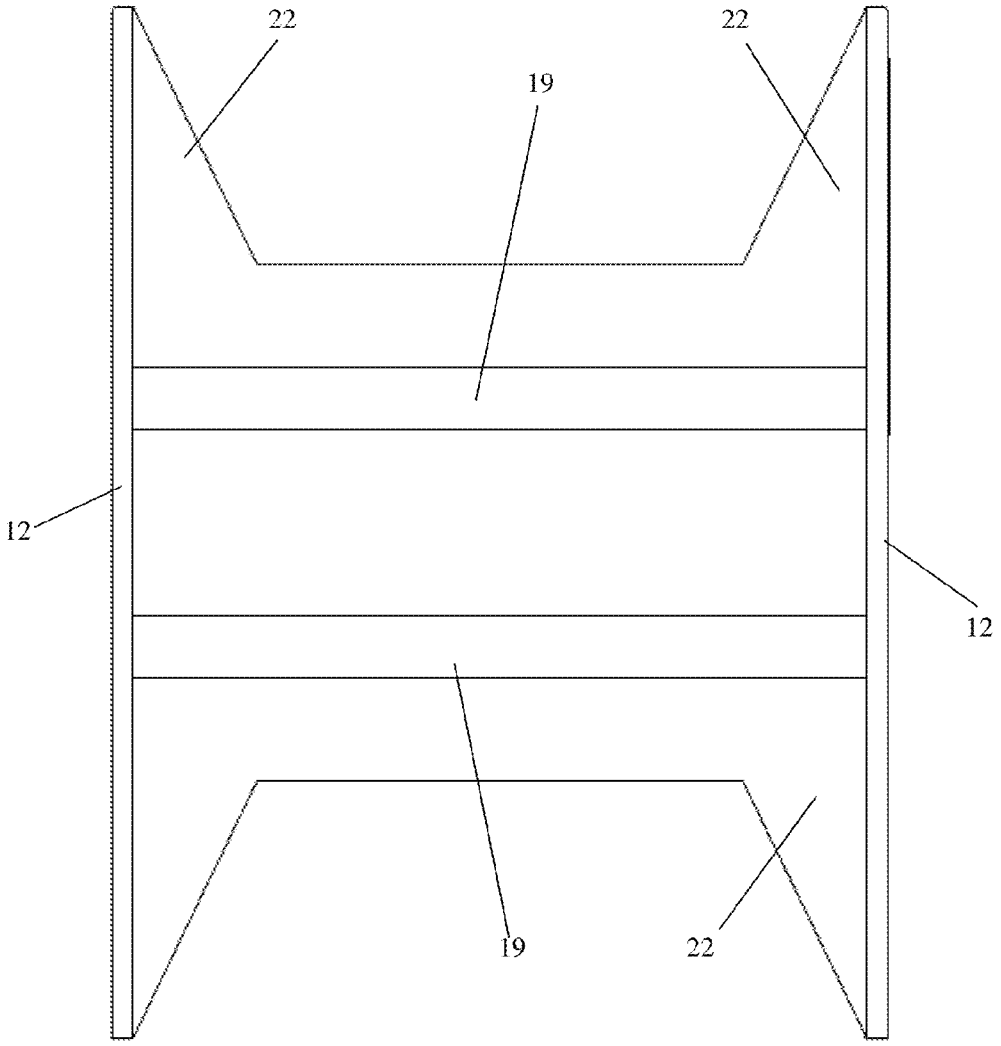
FIG. 4 is a view from below of the joist connector illustrated in FIG. 1.

According to a particularly preferred embodiment of the present invention, a joist connector 10 is provided.

As illustrated, the joist connector 10 of the preferred configuration includes a unitary body with a first channel 11 defined by two spaced apart flanges 12, 13 and a second channel 14 defined by two spaced apart flanges 15, 16 and which is perpendicular from the first channel 11.

The joist connector 10 illustrated has a one-piece construction moulded from Nylon 6. The joist connector has been conditioned in order to increase the strength of the material.

As illustrated, the first channel 11 is substantially perpendicular to the second channel 14 but may be at an angle other than perpendicular if desired. In use, the first channel 11 receives a portion of a beam.

The pair of flanges 12, 13 defining the first channel 11 are planar and parallel to one another. The flanges 12, 13 are spaced from one another by a standard distance which corresponds to a standard or preferred width of a support beam. The flanges 12, 13 typically receive a support beam there between and the flanges 12, 13 are then attached directly to the beam. The joist connector will therefore be available in a variety of dimensions, with the first channel and second channel having different dimensions to correspond to standard beam and joist dimensions.

Each of the flanges 12, 13 will normally be slightly resilient due in part to the material used but mainly due to the dimension of the flanges. The slight resilience allows a small amount of deformation to occur in order to allow the first channel 11 to receive the beam. Typically, the beam will be received in a close fit with internal surfaces of each of the flanges 12, 13 abutting sidewalls of the beam.

According to the preferred embodiment, a transverse wall 17 is provided connecting the flanges 12, 13 together. Normally, in use, the transverse wall 17 also abut a sidewall of the beam when the joist connector 10 is properly located allowing the beam to support the transverse wall 17.

A number of openings 18 are provided in each of the flanges 12, 13 in order to allow a fastener to be driven through an opening 18 and into the beam. Typically the fasteners will be elongate fasteners such as screws or nails with an enlarged heads. In use, the elongate fasteners will typically be driven through the openings 18 into the beam such that the head of the fasteners will abut the periphery of the opening in the flange 12, 13 to attach the joist connector 10 to the beam. Normally the elongate fasteners extend laterally into the beam.

As illustrated, the second channel 14 is substantially perpendicular to the first channel 11. The second channel 14 is typically adapted to receive a portion of a joist.

The pair of flanges 15, 16 defining the second channel 14 are planar and parallel to one another. The flanges 15, 16 are typically spaced from one another by a standard distance which corresponds to a standard or preferred width of a joist. The flanges typically receive the joist there between and the flanges 15, 16 are then preferably attached directly to the joist.

Each of the flanges 15, 16 is slightly resilient due in part to the material used but mainly due to the dimension of the flanges 15, 16. The slight resilience preferably allows a small amount of deformation to occur in order to allow the second channel 14 to receive the joist. Typically, the joist will be received in a close fit with internal surfaces of each of the flanges 15, 16 abutting sidewalls of the joist.

A transverse wall 17 is provided connecting the flanges 15, 16 together. In use, the transverse wall 17 will also abut a lower sidewall of the joist when the joist connector is properly located allowing the joist to be supported by the transverse wall 17. According to the particularly preferred embodiment illustrated, the transverse wall 17 of the second channel 14 is also the transverse wall 17 of the first channel 11.

A pair of spaced ridges 19 is provided on the second channel side of the transverse wall 17 connecting the flanges 15, 16. Each of the spaced ridges has a surface which is substantially coplanar with the other in order to space the joist from the transverse wall 17. The spaced ridges 19 illustrated are parallel to one another and extend across the width of the transverse wall 17. One or more channels 20 are defined between the spaced ridges 19 and this may allow drainage through the joist connector beneath the joist.

A number of openings 21 are provided in each of the flanges 15, 16 in order to allow a fastener to be driven through an opening 21 and into the joist. Typically the fasteners are elongate fasteners such as screws or nails with an enlarged heads. In use, the elongate fasteners will typically be driven through the openings 21 into the joist such that the head of the fasteners will abut the periphery of the opening in the flange to attach the joist connector to the joist. Normally the elongate fasteners extend laterally into the joist.

Bracing wings 22 are provided in order to brace the flanges relative to one another. As illustrated, the bracing wings 22 are substantially triangular shaped with one portion abutting one of the flanges and a second portion abutting another of the flanges or another bracing wing.

Figure 5:
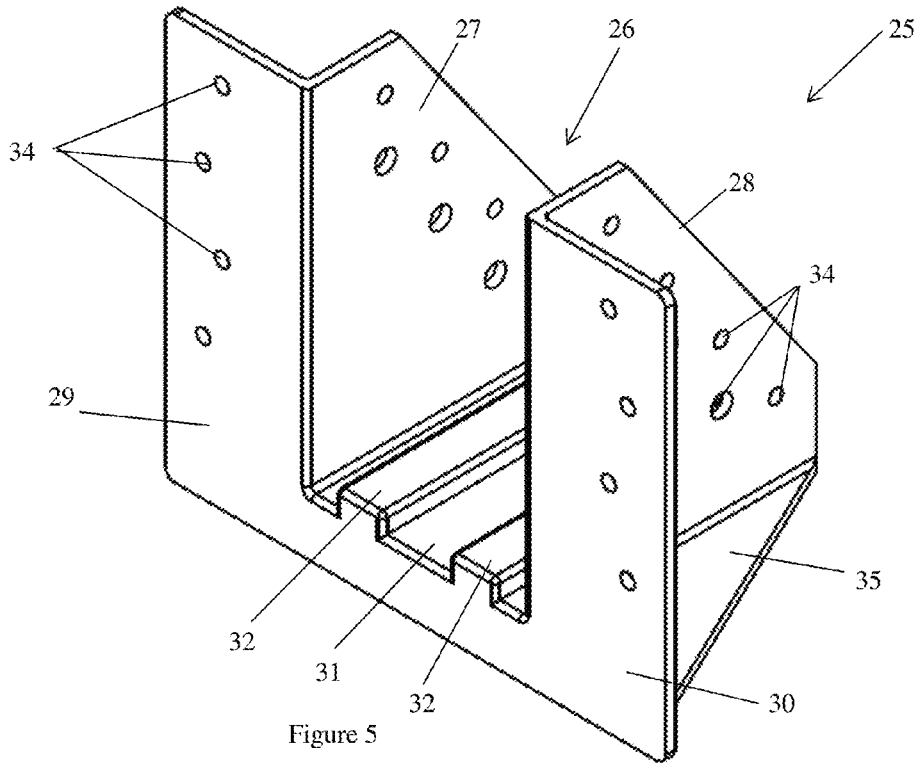
FIG. 5 is a front isometric view of a joist connector according to another embodiment of the present invention.
Figure 6:
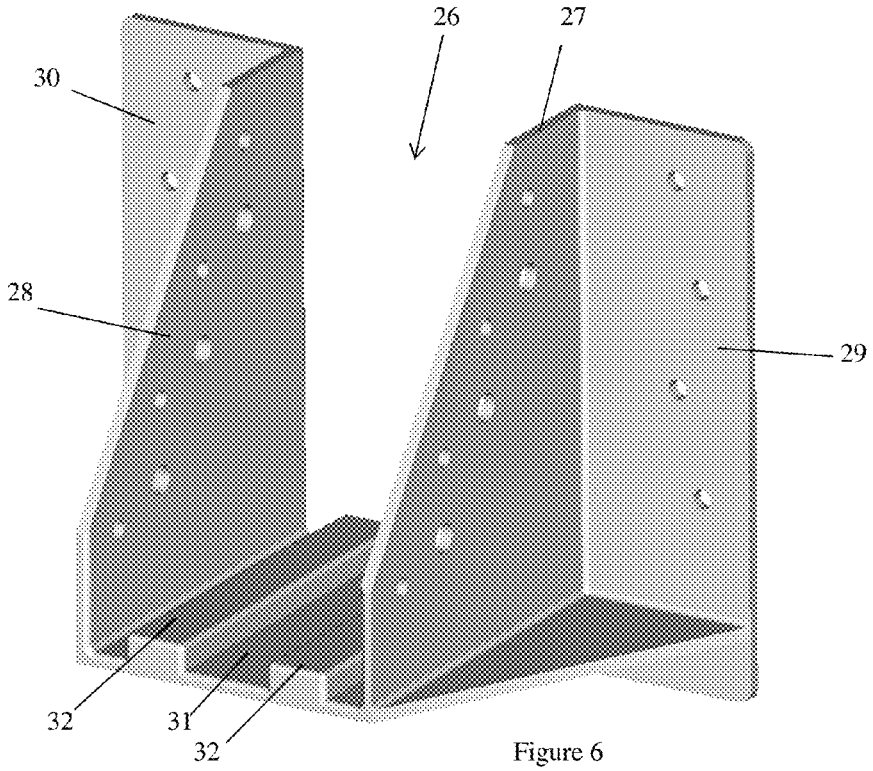
FIG. 6 is a back isometric view of the joist connector illustrated in FIG. 5.
Figure 7:
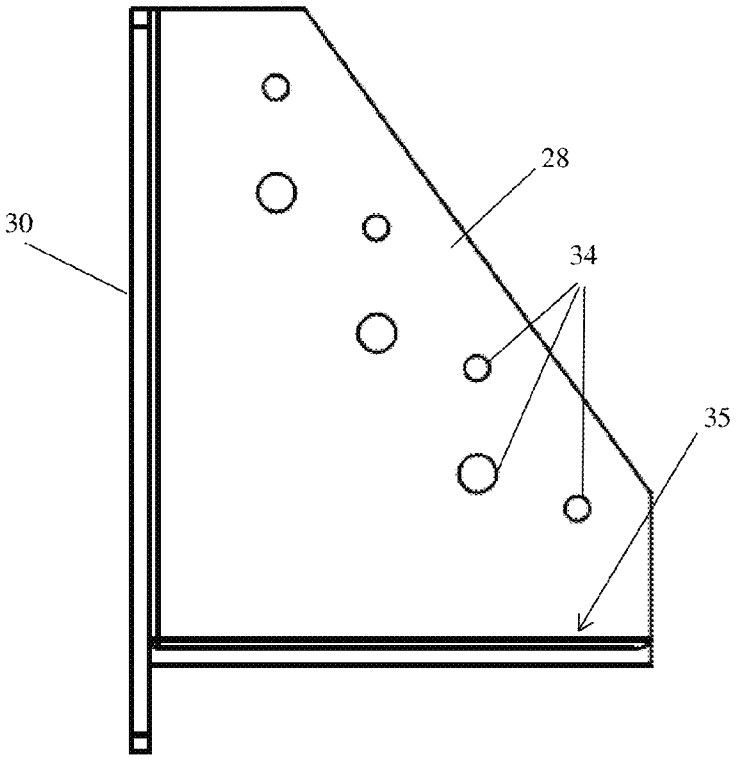
FIG. 7 is a side elevation view of the joist connector illustrated in FIG. 5.
Figure 8:
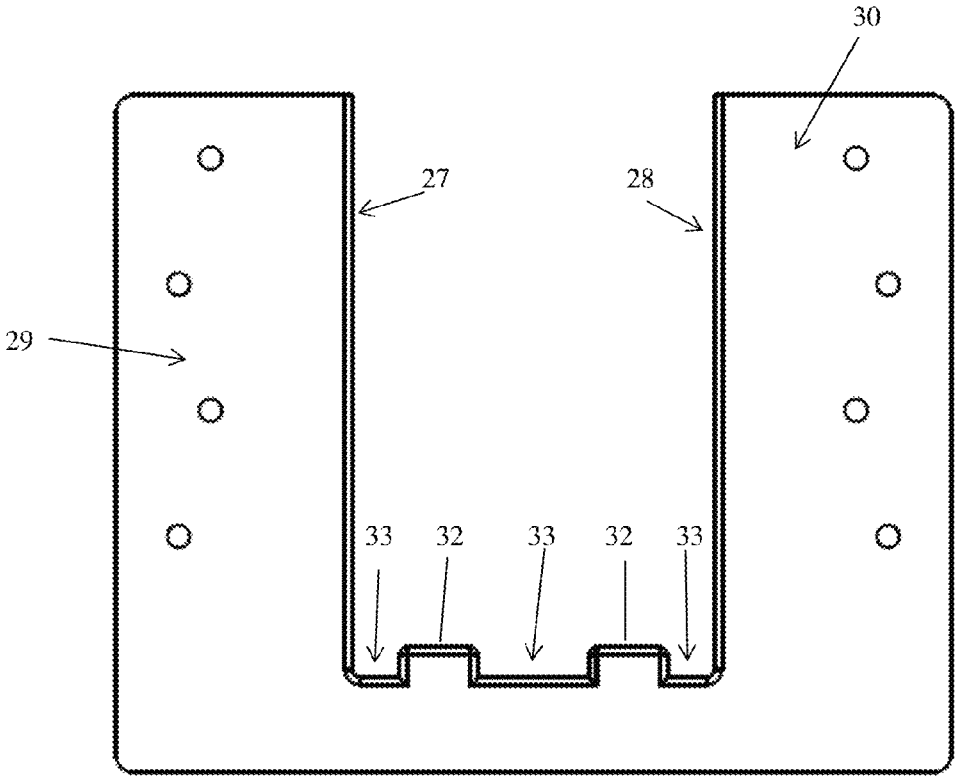
FIG. 8 is a front elevation view of the joist connector illustrated in FIG. 5.

In an alternative preferred embodiment as illustrated in FIGS. 5 to 8, the joist connector 25 includes a unitary body with a channel 26 defined by at least two spaced apart flanges 27, 28 and a face mount assembly defined by at least two spaced apart flanges 29, 30 offset from the channel 26.

In this embodiment, the joist connector is provided to face mount a beam or joist relative to a second beam or joist. This configuration of joist connector is typically provided at the end of a beam or joist.

As illustrated, the channel 26 is substantially perpendicular to the flanges 27, 28 of the face mount assembly but may be at an angle other than perpendicular if desired.

The pair of spaced apart flanges 27, 28 of the channel 26 are parallel to one another and each flange is planar. The flanges 27, 28 are spaced from one another by a standard distance which corresponds to a standard or preferred width of a support beam and various sizes of joist connector will normally be provided for different standard or preferred width. The flanges 27, 28 receive a support beam therebetween and the flanges 27, 28 are then attached directly to the beam.

Typically, the beam will be received in a close fit with the internal surfaces of each of the flanges 27, 28 abutting the sidewalls of the beam.

A transverse wall 31 is provided connecting the flanges 27, 28 together at one end thereof. Normally, the transverse wall 31 also supports a sidewall of the beam when the joist connector is properly located to support the beam.

According to the illustrated embodiment, a pair of spacer ridges 32 are provided on the transverse wall 31, each with a surface which is substantially coplanar in order to space the joist from the transverse wall 31. The spacer ridges 32 are parallel to one another, spaced apart and extend across the width of the transverse wall 31. One or more channels 33 are defined between the spacer ridges 32 to allow drainage through the joist connector beneath the joist, limiting rot.

The face mount assembly of this embodiment includes a pair of spaced apart flanges 29, 30. The flanges 29, 30 of the face mount assembly are substantially perpendicular to the channel 26. As the name suggests, the face mount assembly is typically adapted to abut a beam or joist in order to mount the beam in the channel relative thereto in a face mount configuration.

The pair of flanges 29, 30 of the illustrated embodiment are coplanar with one another. Each flange is preferably planar. The flanges are typically spaced from one another by a standard distance which corresponds to the width of the channel 26. The flanges typically receive the beam or joist being therebetween and are then preferably attached directly to a second beam or joist.

A number of openings 34 are provided in each of the flanges in order to allow a fastener to be driven through an opening and into the beam or joist. Typically the fasteners will be elongate fasteners such as screws or nails with an enlarged heads. In use, the elongate fasteners will typically be driven through the openings into the beam such that the head of the fasteners will abut the periphery or surround of the opening in the flange to attach the joist connector to the beam. Normally the elongate fasteners extend laterally into the beam.

Bracing structures 35 will typically be provided in order to brace the respective flanges of the channel relative to the respective flanges of the face mount assembly. Typically, bracing members are provided in order to brace the flanges in both directions. The bracing members will normally be substantially triangular shaped with one portion abutting one of the flanges and a second portion abutting another of the flanges or another bracing portion preferably integrally formed therewith.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

What is claimed is:

1. A joist connector includes a unitary plastic body with a first channel defined by at least two spaced apart flanges, the first channel being open at both ends, and a second channel defined by at least two spaced apart flanges, the second channel being open at both ends and offset from the first channel, wherein at least one of the first channel or the second channel have one or more full length spacer ridges extending into the respective first channel or second channel over a full length of the channel and extending parallel to the flanges defining the respective first channel and second channel, wherein at least one of the first channel or second channel have one or more bracing structures molded into the body to connect and brace the at least two spaced apart flanges of at least one of the first channel or the second channel relative to one another.

2. A joist connector as claimed in claim 1 wherein the first channel is substantially perpendicular to the second channel.

3. A joist connector as claimed in claim 1 wherein the at least two spaced apart flanges of the first channel are planar and parallel to one another.

4. A joist connector as claimed in claim 1 wherein a base wall is provided connecting the at least two spaced apart flanges of the first channel together.

5. A joist connector as claimed in claim 1 wherein the at least two spaced apart flanges of the second channel are planar and parallel to one another.

6. A joist connector as claimed in claim 1 wherein a base wall is provided connecting the at least two spaced apart flanges of the first channel together and the base wall also connects the at least two spaced apart flanges of the second channel together.

7. A joist connector as claimed in claim 6 wherein the base wall of the joist connector is supported by a beam or joist and supports a second beam or joist thereon.

8. A joist connector as claimed in claim 6 wherein one or more spacer ridges are further provided on the second channel side of the base wall in order to space the joist from the base wall.

9. A joist connector as claimed in claim 1 wherein a number of openings are provided in each of the at least two spaced apart flanges of the first channel and/or the second channel in order to allow a fastener to be driven through an opening and into a joist.

10. A joist connector as claimed in claim 1 wherein one or more bracing structures are provided in order to brace the at least two spaced apart flanges of the first channel and/or the second channel relative to one another.

11. A joist connector including a unitary plastic body with a first channel defined by a base wall and at least two spaced apart flanges, the first channel open at both ends and a second channel defined by a base wall and at least two spaced apart flanges, the second channel open at both ends and offset from the first channel wherein the base wall of at least one of the first channel or second channel has one or more full length spacer ridges to space a member located within the at least one of the first channel or second channel from the base wall of the at least one of the first channel or second channel, the one or more full length spacer ridges provided extending into the respective first channel or second channel over the full length of the channel and extending parallel to the flanges defining the respective first channel or second channel.

* * * * *